US011078685B2

(12) United States Patent
Jaradi

(10) Patent No.: US 11,078,685 B2
(45) Date of Patent: Aug. 3, 2021

(54) VEHICULAR LOCK DETECTION SYSTEMS AND METHODS

(71) Applicant: Continental Automotive Systems Inc., Auburn Hills, MI (US)

(72) Inventor: Malek Jaradi, Macomb, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 16/587,570

(22) Filed: Sep. 30, 2019

(65) Prior Publication Data

US 2020/0208439 A1 Jul. 2, 2020

Related U.S. Application Data

(60) Provisional application No. 62/785,945, filed on Dec. 28, 2018.

(51) Int. Cl.

| | |
|---|---|
| ***E05B 47/02*** | (2006.01) |
| ***G07C 9/00*** | (2020.01) |
| *E05B 47/00* | (2006.01) |

(52) U.S. Cl.

CPC ..... *E05B 47/02* (2013.01); *G07C 9/00571* (2013.01); *E05B 47/0012* (2013.01)

(58) Field of Classification Search

CPC ..... E05B 47/02; E05B 47/0012; E05B 81/74; E05B 81/16; E05B 81/72; E05B 81/06; G07C 9/00571; G07C 2009/00634; G07C 9/00174; B60R 25/00

See application file for complete search history.

(56) References Cited

U.S. PATENT DOCUMENTS

2006/0138866 A1* 6/2006 Bergmann ..... E05B 81/78 307/10.5
2009/0295553 A1* 12/2009 Van Wiemeersch ..... B60R 25/2009 340/425.5
2015/0233145 A1* 8/2015 Kuriyama ..... E05B 41/00 292/201
2016/0010366 A1* 1/2016 Rowe ..... B60R 25/2009 340/5.72
2016/0221501 A1* 8/2016 Linden ..... E05B 81/72
2017/0362860 A1* 12/2017 Salter ..... B60Q 1/50
2018/0066453 A1* 3/2018 Dobbins ..... E05B 15/022
2019/0390485 A1* 12/2019 Konchan ..... E05B 77/30

FOREIGN PATENT DOCUMENTS

EP 2877656 B1 9/2018

OTHER PUBLICATIONS

Specification, Abstract and Figures from Application No. In 9226DELNP2014, counterpart to EP 2877656.

* cited by examiner

*Primary Examiner* — Ryan W Sherwin

(57) ABSTRACT

A lock system for a vehicle includes an electronic control module, an actuator in communication with the electronic control module, a lock member movable between an unlocked position and a locked position by the actuator, a sensor for sensing at least one of a current and a voltage supplied from the electronic control module to the actuator, and a processor configured to execute lock verification logic to determine whether the lock member moved from the unlocked position to the locked position based on the at least one of the current and the voltage sensed by the sensor.

16 Claims, 5 Drawing Sheets

VEHICULAR LOCK DETECTION SYSTEMS AND METHODS

CROSS-REFERENCE TO RELATED APPLICATIONS

This application claims priority to U.S. Provisional Application No. 62/785,945, filed Dec. 28, 2018.

BACKGROUND

Locks for vehicle doors include an electronic control module (ECM), an actuator, and a locking member. Upon receiving a lock instruction, the ECM powers the actuator to move the locking member.

Modern vehicles can be remotely instructed to lock their doors, such as by pressing a lock button on a key fob.

SUMMARY

A lock system for a vehicle according to an exemplary embodiment of this disclosure, among other possible things, includes an electronic control module, an actuator in communication with the electronic control module, a lock member movable between an unlocked position and a locked position by the actuator, a sensor for sensing one at least one of a current and a voltage supplied from the electronic control module to the actuator, and a processor configured to execute lock verification logic to determine whether the lock member moved from the unlocked position to the locked position based on the one of the current or the voltage sensed by the sensor.

In a further example of the foregoing, the sensor is configured to sense the time between a start point and a stall condition. The processor is configured to determine whether the lock member is moved from the unlocked position to the locked position based on the sensed time between the start point and the stall condition.

In a further example of any of the foregoing, the stall condition is based on a plateau in a plot of current against time.

In a further example of any of the foregoing, the stall condition is based on a second peak in a plot of current against time.

In a further example of any of the foregoing, the lock member is configured to lock a door of the vehicle.

A method for signaling the success of a locking function according to an exemplary embodiment of this disclosure, among other possible things, includes monitoring the current supplied to an actuator for a stall condition after a start point of a plot of current against time for the locking function, determining whether the locking function was successful based on a length of time between the start point and occurrence of the stall condition, and signaling whether the locking function was successful.

In a further example of the foregoing, the method includes determining that the locking function was unsuccessful if the length of time is less than an expected time.

In a further example of any of the foregoing, the method includes adjusting the expected time based on ambient temperature.

In a further example of any of the foregoing, method includes determining that the locking function was successful if the length of time is greater than or equal to an expected time.

In a further example of any of the foregoing, the locking function is executed by a vehicle door lock system.

In a further example of any of the foregoing, the vehicle door lock system includes an electronic control module (ECM), the actuator, and a lock member.

In a further example of any of the foregoing, the step of determining whether the locking function was successful is performed by the ECM.

In a further example of any of the foregoing, the signaling step includes notifying a user of an outcome of the determining whether the locking function was successful.

In a further example of any of the foregoing, the locking function is executed by a door lock in a vehicle, and notifies the user of the outcome includes chirping the vehicle's horn a first number of times if the locking function was successful and chirping the vehicle's horn a second number of times if the locking function was unsuccessful, and the first number is different from the second number.

In a further example of any of the foregoing, the locking function is executed by a door lock in a vehicle associated with a key fob, and notifies the user of the outcome includes flashing a first light pattern from the fob if the locking function was successful and flashing a second light pattern from the fob if the locking function was unsuccessful, and the first light pattern is different from the second light pattern.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

This disclosure describes systems and methods for locking, including verifying and signaling successful or unsuccessful locking. In some prior art lock systems, such as in vehicle applications, because a remote user may not be able to observe a locking door directly, some vehicles have signals to notify remote users that a door was successfully locked. For example, a vehicle that receives a remote lock instruction might give a single chirp of its horn to signal successful locking, or a double chirp to signal unsuccessful locking. Key fobs may have indicators such as light emitting diodes (LED's) that blink different colors or patterns to indicate successful or unsuccessful locking. A prior art lock system typically determines whether locking was successful based solely on whether the vehicle's doors are closed.

Figure 1:
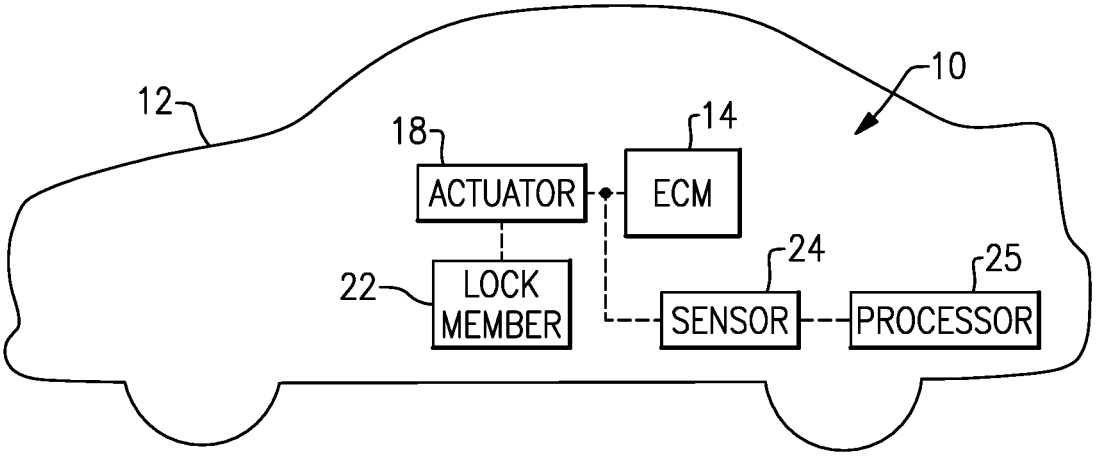
FIG. 1 is a schematic illustration of an exemplary lock system in a vehicle.

FIG. 1 schematically illustrates an example lock system 10 for a vehicle 12. In the example, the lock system 10 is for a door lock of the vehicle 12, but other mechatronically driven locks, including but not limited to home locks, gate locks, and safe locks, may benefit from this disclosure. The lock system 10 includes an electronic control module (ECM) 14, an actuator 18, and a lock member 22. The ECM 14 controls the actuator 18 to move the lock member 22 to a locked position. In some examples, the actuator 18 moves the lock member 22 to a locked position when the vehicle 12 receives a locking instruction.

In some examples, as shown, the lock system 10 includes one or more sensors 24 to monitor current supplied to the actuator 18 and a processor 25 capable of executing lock verification logic to determine whether locking function was successful, as described further below. In some examples, the processor 25 that executes the lock verification logic is part of the ECM 14.

Figure 2:
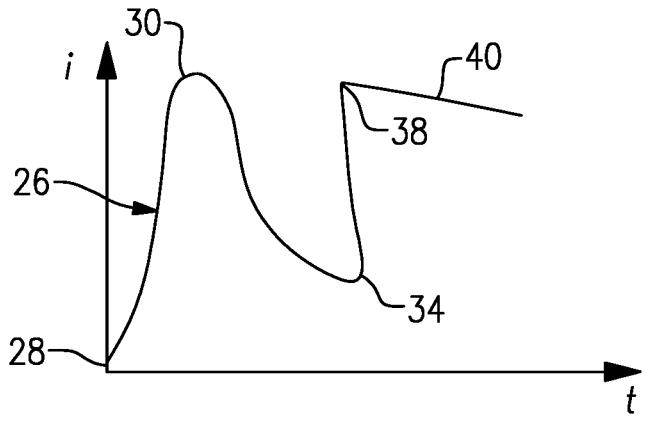
FIG. 2 is an example plot of current against time for an example successful locking function.

FIG. 2 illustrates an approximate curve 26 of a plot of current against time for current supplied to the actuator 18 to successfully lock a door of the vehicle 12 (with reference to FIG. 1). The typical curve 26 begins at start point 28, corresponding to a time when the lock system 10 begins to execute a locking function. The curve 26 ascends from the start point 28 to an initial peak 30, corresponding to an impulse of current to begin movement of the lock member 22 (see FIG. 1). The curve 26 descends from the initial peak 30 to a trough 34, corresponding to a period of unobstructed travel by the lock member 22. The trough 34 is followed by a second peak 38, and the second peak 38 is followed by a plateau 40 at a stall current. The second peak 38 occurs when the lock member 22 reaches the end of its range of travel and the ECM 14 supplies more current in an attempt to continue to drive the actuator 18 at a constant speed. Upon reaching the second peak 38, the actuator 18 stalls, and the current levels out to the plateau 40.

Figure 3:
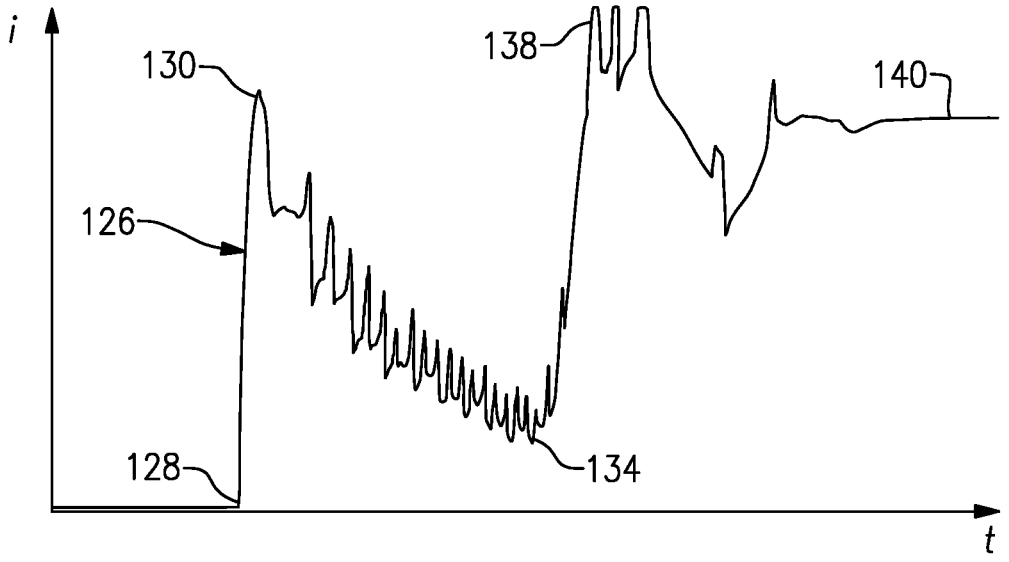
FIG. 3 is another example plot of current against time for another example successful locking function.

FIG. 3 illustrates another approximate curve 126 of current against time for current supplied to the actuator 18 to successfully lock a door of the vehicle 12, substantially similar to the curve shown in FIG. 2. It should be understood that like reference numerals identify corresponding or similar elements throughout the several drawings.

The lock system 10 will take an equal, or approximately equal, amount of time to reach a stall condition on each successful locking function. In some examples, the processor 25 may be programmed to determine the stall condition based on the stall current plateau 40. In some examples, the processor 25 may be programmed to determine the stall condition based on the second peak 38. The time to the stall condition may vary slightly depending on battery voltage or certain ambient atmospheric conditions, such as temperature. In some examples, the processor 25 may be programmed to have a tolerance for certain variances of time to reach the stall current plateau 40.

Figure 4:
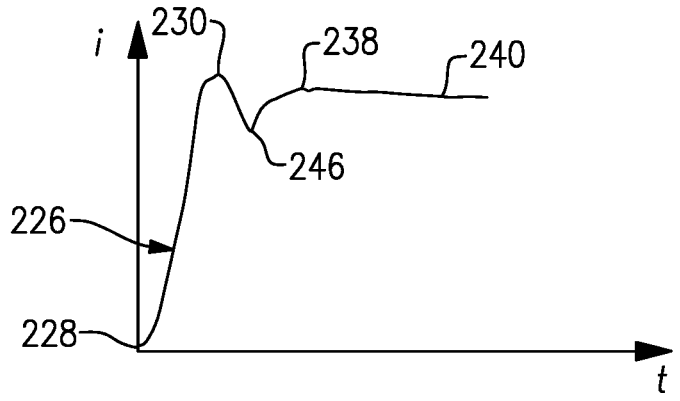
FIG. 4 is another example plot of current against time for an example unsuccessful locking function.

FIG. 4 illustrates an example curve 226 of an unsuccessful locking function. An unsuccessful locking function, such as, in some examples, an attempt to lock a door of the vehicle 12 when the locking member 22 is obstructed or otherwise encounters a pinch condition, or something that impedes the lock member from moving to its final locked destination, would result in a truncated curve 226 as shown in FIG. 4. The illustrated truncated curve 226 similarly includes a start point 228 and initial peak 230, but the initial peak 230 is followed by a small dip 246, which leads to a premature second peak 238 and premature plateau 240.

Figure 5:
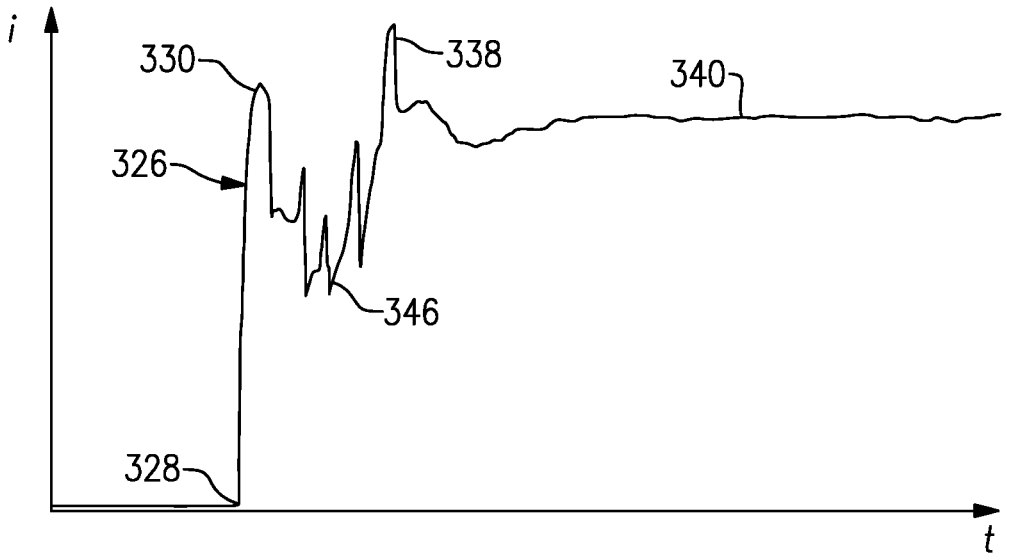
FIG. 5 is another example plot of current against time for another example unsuccessful locking function.

FIG. 5 illustrates another example curve 326 of another unsuccessful locking function, substantially similar to the curve 226 shown in FIG. 4, including a start point 328, initial peak 330, dip 346, premature second peak 338, and premature plateau 340.

Figure 6:
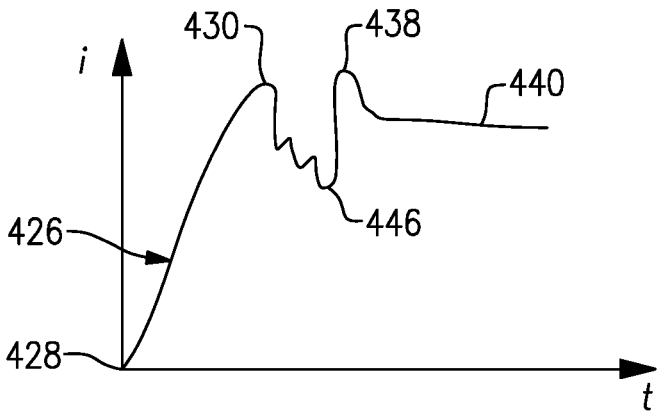
FIG. 6 is another example plot of current against time for another example unsuccessful locking function.

As shown in FIG. 6, in some examples, a truncated curve 426 indicative of an unsuccessful locking function may have a more delayed dip 446 relative to the dips shown in FIGS. 4 and 5. The example curve 426 includes a start point 428, initial peak 430, dip 446, premature second peak 438, and premature plateau 440.

Figure 7:
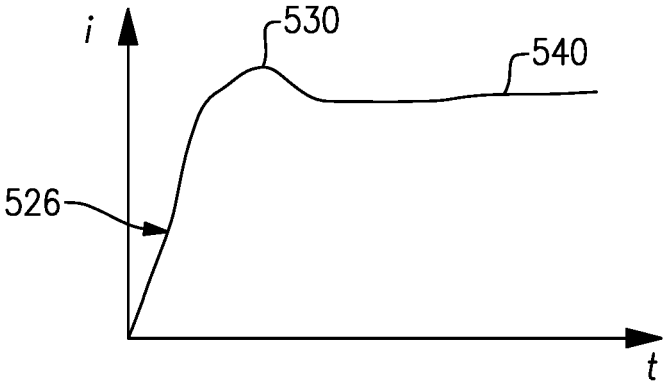
FIG. 7 is another example plot of current against time for another example unsuccessful locking function.
Figure 8:
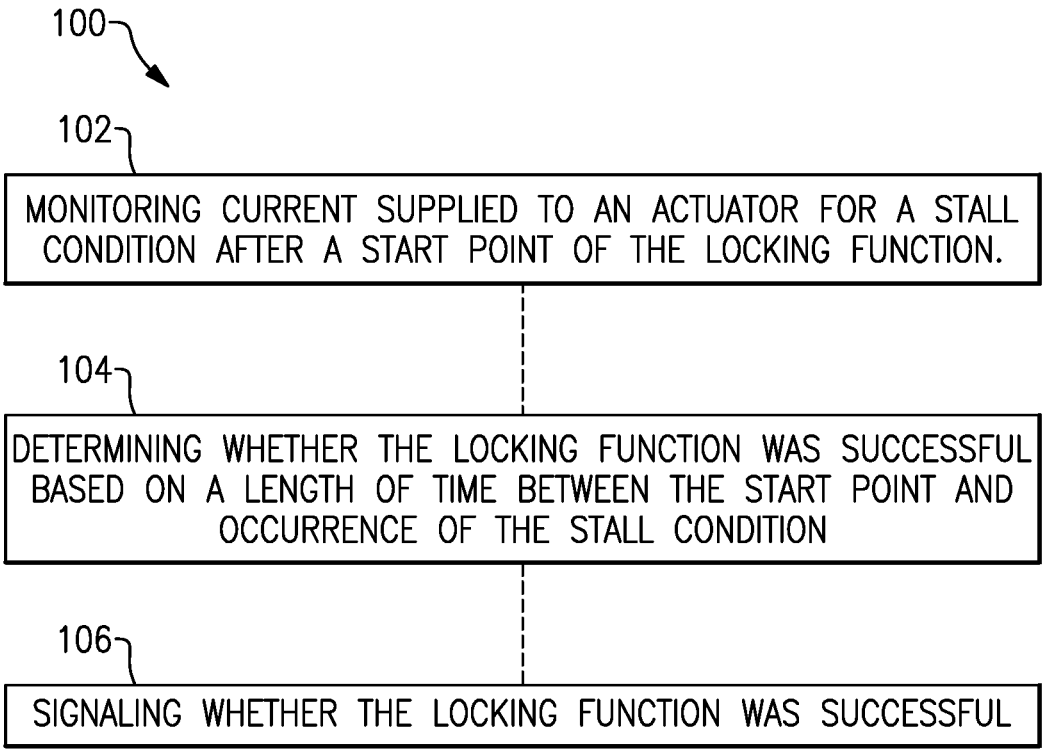
FIG. 8 is a flow chart of an example method for signaling whether a locking function was successful.

As shown in FIG. 7, in some examples, a truncated curve 526 may have no dip at all, such that a premature plateau 540 is reached immediately after the first peak 530.

With reference to FIG. 1, the example processor 25 is capable of executing lock verification logic to determine whether the door locked successfully based on expected current, voltage, and/or time values compared to values that actually occurred. In some examples, the example processor 25 is capable of executing lock verification logic to determine whether the door locked successfully based on comparing the expected time to reach a stall condition with the actual time to reach a stall condition. In some examples, the stall condition is based at least in part on the second peak 38/138/238/338/438. In some examples, the stall condition is based at least in part on the plateau 40/140/240/340/440/540.

In some examples, the lock verification logic includes monitoring the current supplied to the actuator 18 to determine when the supply reaches a stall current plateau 40/140/240/340/440/540. In some examples, the logic determines that the locking function was unsuccessful if the stall current plateau 40/140/240/340/440/540 occurs before a critical time. In some examples, the logic determines that the locking function was successful if the stall current plateau 40/140/240/340/440/540 occurs after a critical time. In some examples, the critical time is adjusted for at least one of battery voltage and ambient atmospheric conditions, such as temperature. In some examples, the logic could also be configured for monitoring voltage supply instead of, or in addition to, current supply.

In some examples, the lock verification logic includes monitoring the current supplied to the actuator 18 for whether the current dips below an expected threshold after the initial peak 30. With reference to FIGS. 2-6, the trough 34/134 consistent with a successful locking function will consistently be below a certain predetermined threshold, while the dip 246/346/446 associated with an unsuccessful locking function will not sink as low. Accordingly, the lock verification logic can determine that the locking function was successful if a trough 34/134 below the predetermined threshold is detected, or that the locking function was unsuccessful if no trough 34/134 below the predetermined threshold is detected. The predetermined threshold can also be adjusted in view of battery voltage or atmospheric conditions such as temperature.

Upon reaching a determination, the vehicle 12 can signal to the user whether the locking function was successful or unsuccessful. In some examples, the signal may be one or more of audio, visual, or touch. In some examples, the signal can be accomplished by chirps from the horn or visual or sound indications from a key fob.

With reference to FIGS. 1-7, FIG. 8 illustrates an example method 100 in accordance with the example lock system 10. At 102, the example method 100 includes monitoring current supplied to an actuator for a stall condition after a start point of the locking function. At 104, the example method 100 includes determining whether the locking function was successful based on a length of time between the start point and occurrence of the stall condition. At 106, the example method 100 includes signaling whether the locking function was successful.

In some examples, the method 100 may include determining that the locking function was unsuccessful if the actual length of time is less than an expected time. In some examples, the method 100 may include adjusting the expected time based on ambient temperature. In some examples, the method 100 may include determining that the locking function was successful if the length of time is greater than or equal to an expected time. In some examples, the method 100 may include that the locking function is executed by a vehicle door lock system. In some examples, the method 100 may include that the lock system includes an ECM 14, the actuator 18, and a lock member 22. In some examples, the method 100 may include determining whether the locking function was successful is performed by the ECM.

In some examples, the method 100 may include notifying a user of an outcome of the determining whether the locking function was successful. In some examples, the method 100 may include that the locking function is executed by a door lock in a vehicle. In some examples, the notifying the user of the outcome step may include chirping the vehicle's horn a first number of times if the locking function was successful and chirping the vehicle's horn a second, different number of times if the locking function was unsuccessful. In some examples, the method 100 may include that the locking function is executed by a door lock in a vehicle associated with a key fob, and the notifying the user of the outcome includes flashing a first light pattern from the fob if the locking function was successful and flashing a second, different light pattern from the fob if the locking function was unsuccessful.

Although the examples may generally suggest a mechanical door lock, the lock verification logic can be applied to electrical door locks in some examples. In some examples, a vehicle with mechanical door locks has one ECM governing a driver door, and another governing all other doors on the vehicle. In examples with electrical locks, vehicles with electrical locks may have separate control units for each door lock, which would enable the lock verification logic to determine whether a locking function was successful for each lock individually.

Though the above disclosure generally discusses a lock for a vehicle door, other applications for the verification logic are expressly contemplated. For example, the same logic could be employed to detect obstruction in many applications involving an actuator and member expected to travel a given distance before stalling. The logic could also be used to determine a bidirectional status of the position of the lock member.

It should also be understood that although a particular component arrangement is disclosed in the illustrated examples, other arrangements will benefit herefrom. Although particular step sequences are disclosed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A lock system for a vehicle comprising:

an electronic control module;

an actuator in communication with the electronic control module;

a lock member movable between an unlocked position and a locked position by the actuator;

a sensor configured to sense at least one of a current and a voltage supplied from the electronic control module to the actuator;

a processor configured to execute lock verification logic to determine whether the lock member moved from the unlocked position to the locked position based on the at least one of the current and the voltage sensed by the sensor; and wherein the sensor is configured to sense the time between a start point and a stall condition, and the processor is configured to determine whether the lock member moved from the unlocked position to the locked position based on the sensed time between the start point and the stall condition.

2. The lock system as recited in claim 1, wherein the stall condition is based on a plateau in a plot of current against time.

3. The lock system as recited in claim 1, wherein the stall condition is based on a second peak in a plot of current against time.

4. The lock system as recited in claim 1, wherein the lock member is configured to lock a door of the vehicle.

5. The lock system as recited in claim 1, wherein the one of the current or the voltage is the current.

6. The lock system as recited in claim 1, wherein the one of the current or the voltage is the voltage.

7. A method for signaling the success of a locking function, the method comprising:

monitoring current supplied to an actuator for a stall condition after a start point of a plot of current against time for the locking function;

sensing time between the start point and the stall condition;

determining whether the locking function was successful based on a length of the sensed time between the start point and occurrence of the stall condition; and signaling whether the locking function was successful.

8. The method as recited in claim 7, the method comprising determining that the locking function was unsuccessful if the length of time is less than an expected time.

9. The method as recited in claim 8, the method comprising adjusting the expected time based on ambient temperature.

10. The method as recited in claim 7, the method comprising determining that the locking function was successful if the length of time is greater than or equal to an expected time.

11. The method as recited in claim 7, wherein the locking function is executed by a vehicle door lock system.

12. The method as recited in claim 11, wherein the vehicle door lock system includes an electronic control module (ECM), the actuator, and a lock member.

13. The method as recited in claim 12, wherein the step of determining whether the locking function was successful is performed by the ECM.

14. The method as recited in claim 7, wherein the signaling step includes notifying a user of an outcome of the determining whether the locking function was successful.

15. The method as recited in claim 14, wherein the locking function is executed by a door lock in a vehicle, and the notifying the user of the outcome includes chirping the vehicle's horn a first number of times if the locking function was successful and chirping the vehicle's horn a second number of times if the locking function was unsuccessful, and the first number is different from the second number.

16. The method as recited in claim 14, wherein the locking function is executed by a door lock in a vehicle associated with a key fob, and the notifying the user of the outcome includes flashing a first light pattern from the fob if the locking function was successful and flashing a second light pattern from the fob if the locking function was unsuccessful, and the first light pattern is different from the second light pattern.

* * * * *